US012698603B2

(12) United States Patent
Berns et al.

(10) Patent No.: US 12,698,603 B2
(45) Date of Patent: Aug. 4, 2026

(54) PAVING MACHINE INCLUDING SCREED ASSEMBLY WITH COMPRESSION MECHANISMS

(71) Applicant: Caterpillar Paving Products Inc., Brooklyn Park, MN (US)

(72) Inventors: Reece Berns, Blaine, MN (US); Ryan Todd Thiesse, Otsego, MN (US); Toby Frelich, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 571 days.

(21) Appl. No.: 18/325,195

(22) Filed: May 30, 2023

(65) Prior Publication Data

US 2024/0401286 A1 Dec. 5, 2024

(51) Int. Cl.
*E01C 19/48* (2006.01)

(52) U.S. Cl.
CPC ..... *E01C 19/4866* (2013.01)

(58) Field of Classification Search
CPC ..... E01C 19/48; E01C 19/4866
See application file for complete search history.

(56) References Cited

U.S. PATENT DOCUMENTS

| | | | | |
|---|---|---|---|---|
| 3,557,672 | A * | 1/1971 | Shurtz | E01C 19/4873 404/95 |
| 3,743,432 | A * | 7/1973 | Lee | E01C 19/4873 404/84.1 |
| 4,379,653 | A | 4/1983 | Brown | |
| 5,203,642 | A | 4/1993 | Heller et al. | |
| 6,283,672 | B1 | 9/2001 | Sovik | |
| 6,984,089 | B1 * | 1/2006 | Colvard | E01C 19/405 404/96 |
| 7,909,534 | B1 | 3/2011 | Comer et al. | |
| 9,683,337 | B2 | 6/2017 | Ellwein et al. | |
| 2017/0292232 | A1 * | 10/2017 | Marsolek | E01C 23/14 |
| 2021/0198852 | A1 * | 7/2021 | Reindorf | E01C 19/48 |

FOREIGN PATENT DOCUMENTS

| | | | |
|---|---|---|---|
| CN | 201933391 | U | 8/2011 |
| CN | 102337720 | B | 1/2013 |

* cited by examiner

*Primary Examiner* — Abigail A Risic

(57) ABSTRACT

A screed assembly for a paving machine includes a screed plate, an end gate, and compression mechanisms. The screed plate paves a material to form a mat on a work surface. The end gate restricts a spread of the material in a lateral direction of the paving machine. The end gate includes a support structure and a floating wall. The support structure includes an engagement portion and the floating wall is slidably disposed relative to the support structure and is configured to be guided along the work surface during the paving operation. Further, each compression mechanism includes at least one compression member disposed in an engaged state with respect to at least one of the engagement portion and the floating wall. An actuation of the compression member moves the floating wall with respect to the screed plate to adjust a clearance between the floating wall and the screed plate.

13 Claims, 5 Drawing Sheets

PAVING MACHINE INCLUDING SCREED ASSEMBLY WITH COMPRESSION MECHANISMS

TECHNICAL FIELD

The present disclosure relates to a paving machine having a screed assembly with a screed plate. More particularly, the present disclosure relates to compression mechanisms to adjust or reduce a clearance between an end gate of the screed assembly and the screed plate.

BACKGROUND

Paving machines are used to deposit layers of a paving material, such as asphalt, concrete, or aggregate, on a work surface, to form roadways, parking lots, etc. A paving machine generally includes a screed assembly that may be connected to a tractor. The screed assembly may receive a paving material from a hopper by way of a conveying system. The conveying system generally moves the paving material from the hopper and deposits the paving material onto a region of the work surface. The screed assembly may then be pulled over the paving material to grade, level, and smoothen the paving material, over the work surface. In so doing, a layer of the paving material (referred to as a mat) is formed over the work surface with a desired degree of thickness and width.

It is common for screed assemblies to use an end gate along with the screed plate. An end gate generally restricts a spread or distribution of the paving material in a lateral direction relative to a longitudinal movement of the paving machine and helps to define a physical profile and geometry of the mat. However, an improper arrangement or position of the end gate with respect to the screed plate may result in a less than desired surface quality of the mat. For example, an edge of the mat may be improperly formed if a relatively large clearance is present between the end gate and the screed plate.

Chinese Utility Model no.: 201933391 relates to a screed lining plate adjusting device. In the screed lining plate adjusting device, a screed lining plate is connected to the outer side of a screed rack and comprises a base plate which is connected with the screed rack and is positioned above the screed lining plate. A height adjusting piece is arranged on the base plate along the vertical direction. The height adjusting piece is provided with an end matched with the screed lining plate. The screed lining plate can be adjusted so as to make the bottom surface of the screed lining plate flush with the bottom plate of the screed, eliminating the looseness of the screed lining plate caused by vibration and the like in construction.

SUMMARY OF THE INVENTION

In one aspect, the disclosure relates to a screed assembly for a paving machine. The screed assembly includes a screed plate, an end gate, and one or more compression mechanisms. The screed plate paves a material to form a mat on a work surface. The end gate restricts a spread of the material in a lateral direction of the paving machine during a paving operation. The end gate includes a support structure and a floating wall. The support structure includes an engagement portion and the floating wall is slidably disposed relative to the support structure and is configured to be guided along the work surface during the paving operation. Further, each compression mechanism includes at least one compression member disposed in an engaged state with respect to at least one of the engagement portion and the floating wall. An actuation of the compression member moves the floating wall with respect to the screed plate to adjust a clearance between the floating wall and the screed plate.

In another aspect, the disclosure is directed to a paving machine. The paving machine includes a tractor, a hopper, and a screed assembly. The hopper is coupled to the tractor and is configured to receive a material for deposition over a work surface. The screed assembly is coupled to the tractor and includes a screed plate, an end gate, and one or more compression mechanisms. The screed plate paves the material to form a mat on the work surface. The end gate restricts a spread of the material in a lateral direction of the paving machine during a paving operation. The end gate includes a support structure and a floating wall. The support structure includes an engagement portion, while the floating wall is slidably disposed relative to the support structure and is configured to be guided along the work surface during the paving operation. Further, each compression mechanism includes at least one compression member disposed in an engaged state with respect to at least one of the engagement portion and the floating wall. An actuation of the compression member moves the floating wall with respect to the screed plate to adjust a clearance between the floating wall and the screed plate.

In yet another aspect, the disclosure relates to a system for adjusting a position of a floating wall of an end gate with respect to a screed plate of a screed assembly. The system includes an engagement portion and one or more compression mechanisms. The engagement portion is configured to be coupled to a support structure of the end gate. Further, each compression mechanism includes at least one compression member and an abutting piece. The compression member is disposed in an engaged state with respect to at least one of the engagement portion and the floating wall. Furthermore, the compression member is actuatable or movable to a first condition to set a clearance between the floating wall and the screed plate. The abutting piece is disposed between the compression member and the floating wall. The abutting piece is configured to abut and distribute a force exerted by the compression member over a portion of the floating wall when the compression member is moved to the first condition.

DETAILED DESCRIPTION

Reference will now be made in detail to specific embodiments or features, examples of which are illustrated in the accompanying drawings. Generally, corresponding reference numbers may be used throughout the drawings to refer to the same or corresponding parts, e.g., 1, 1', 1", 101 and 201 could refer to one or more comparable components used in the same and/or different depicted embodiments.

Figure 1:
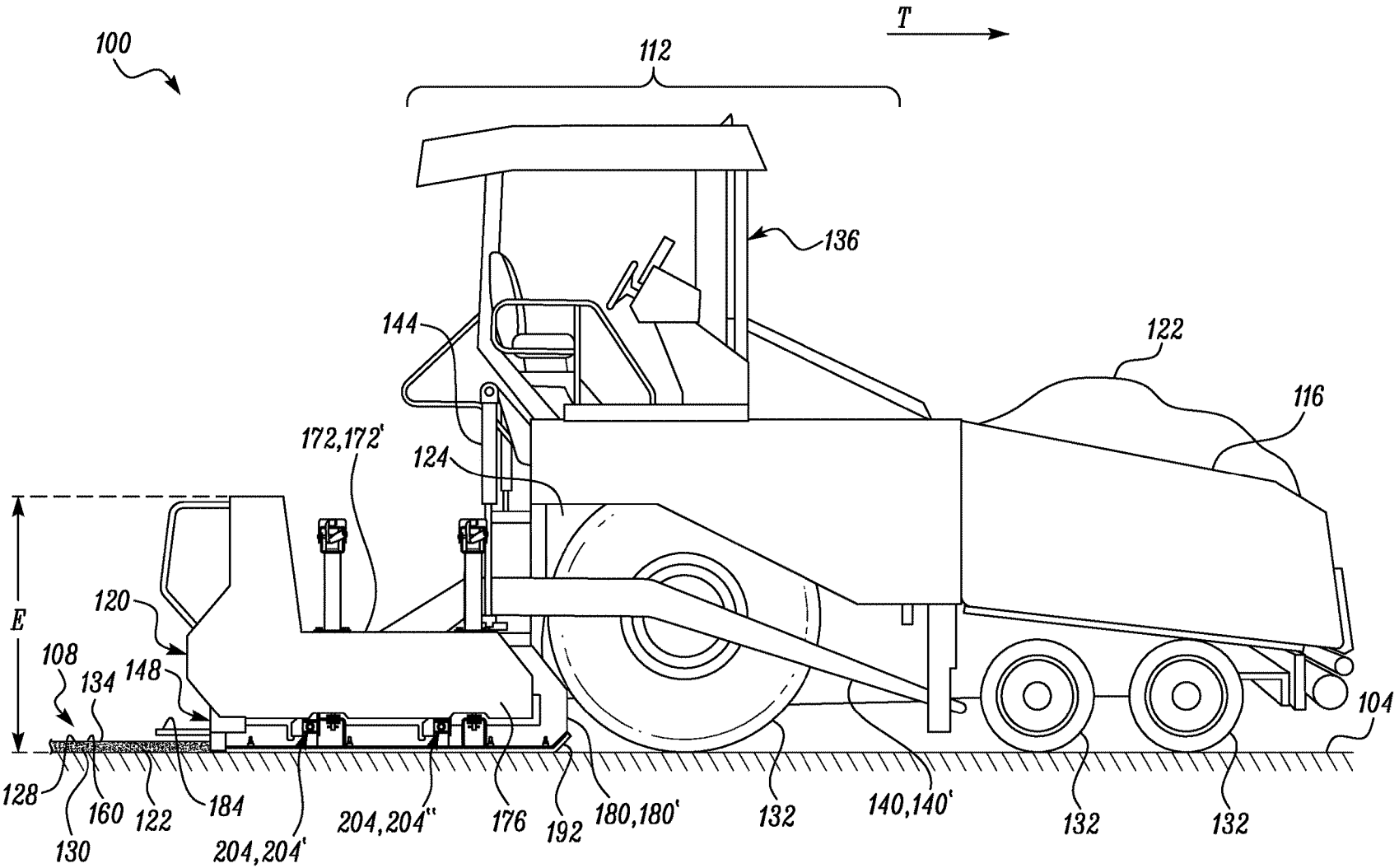
FIG. 1 is a side view of an exemplary paving machine having a screed assembly, in accordance with one or more aspects of the present disclosure.
Figure 2:
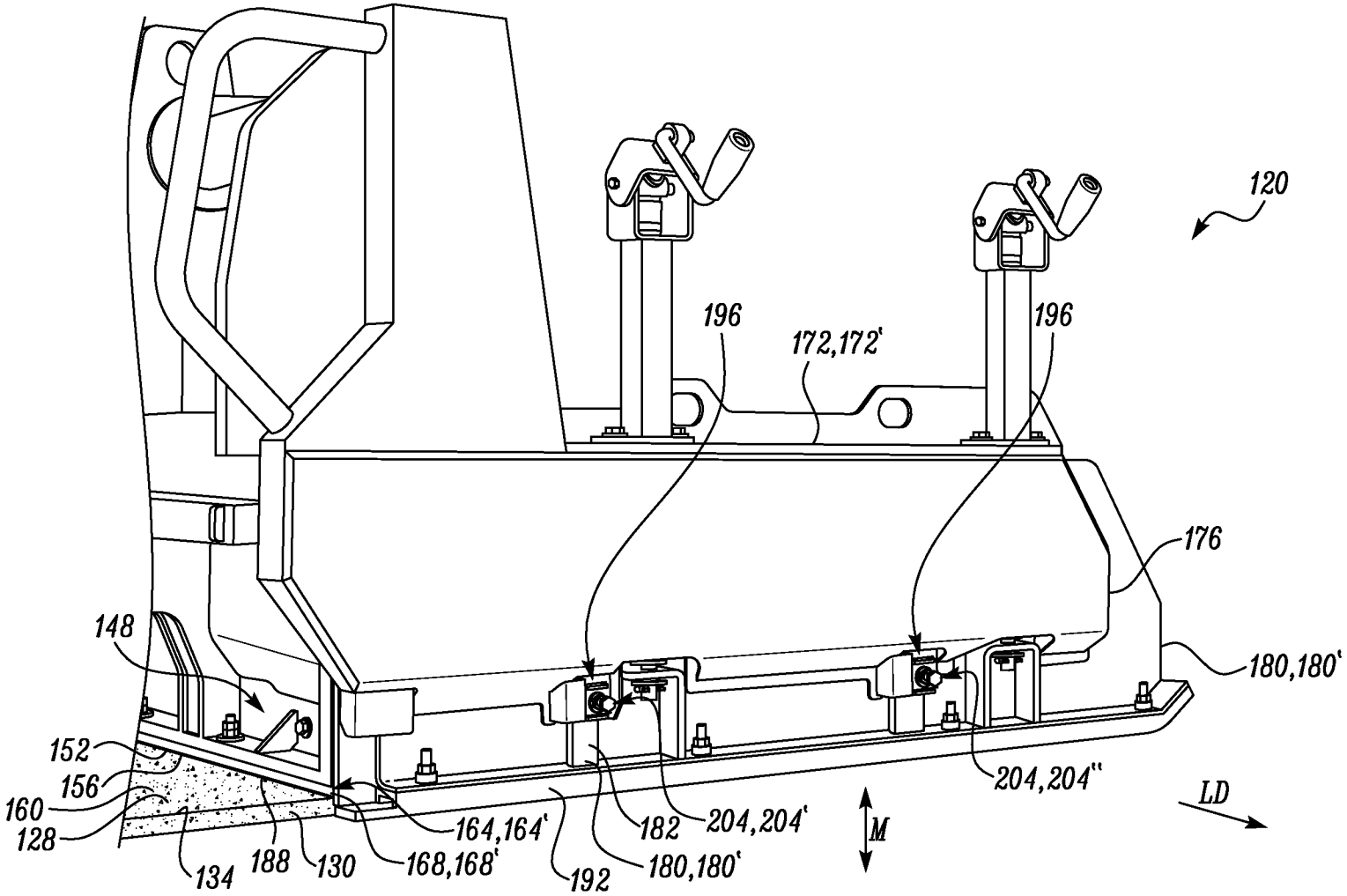
FIG. 2 is an oblique side perspective view of the screed assembly with a screed plate, in accordance with one or more aspects of the present disclosure.

Referring to FIGS. 1 and 2, a paving machine 100 is illustrated. The paving machine 100 may be applied to perform a paving operation over a work surface 104 to form a pathway or a roadway 108 over the work surface 104. To this end, the paving machine 100 may include various parts, e.g., a tractor 112, a hopper 116, and a screed assembly 120. The tractor 112 may enable propulsion or movement of the paving machine 100 over the work surface 104; the hopper 116 may receive and hold a material 122 (e.g., a paving material, such as a hot asphalt mixture), and the screed assembly 120 may pave the material 122 over the work surface 104 to form the roadway 108 on the work surface 104. The paving machine 100 may also include a chassis 124 and each of the tractor 112, the hopper 116, and the screed assembly 120, may be supported on the chassis 124. In that manner, the tractor 112 may be coupled to each of the hopper 116 and the screed assembly 120, and, during the paving operation, the tractor 112 may tow the screed assembly 120 along an exemplary operational direction (see direction, T) such that the screed assembly 120 may trail the tractor 112 along the direction, T, while the hopper 116 may lead the tractor 112 along the direction, T.

The paving machine 100 may include a conveying system (not shown). The conveying system may include belts, chains, and/or augers, and may be applied to transport the material 122 (e.g., the paving material) from the hopper 116 towards the screed assembly 120. To this end, the conveying system may produce a conveying action that may facilitate the transfer of the material 122 held by the hopper 116 towards the screed assembly 120. Elements, such as augers of the conveying system, may enable a deposition of the material 122 over the work surface 104. By moving the paving machine 100 (and/or the screed assembly 120) over the deposited material along direction, T, the deposited material may be forced under the screed assembly 120 to be graded, leveled, and/or shaped by the screed assembly, as part of a pre-compaction process to form a mat 128 over the work surface 104. The mat 128, as formed by way of the pre-compaction process on the work surface 104, may define a desired profile and/or a geometry (e.g., the mat 128 may possess a desired thickness and width).

In some embodiments, the paving machine 100 may be a self-powered machine and its functions, e.g., the paving machine's movement, may be powered by way of a power source (e.g., an internal combustion engine) (not shown). In some embodiments, the tractor 112 may be omitted from the paving machine 100, and one or more of the hopper 116 and/or the screed assembly 120 may be towed, alone or in combination, by another machine (e.g., a dump truck) (not shown). Further, to move the paving machine 100 over the work surface 104, the paving machine 100 may include, among other components and systems, a number of traction devices 132 (e.g., tracks and/or wheels). The traction devices 132 may support and facilitate movement of the chassis 124 (and thus the paving machine 100) over the work surface 104 as the traction devices 132 may receive motive power from the power source.

Further, the paving machine 100 may include an operator station 136. The operator station 136 may be supported over the chassis 124. The operator station 136 may facilitate stationing of one of more operators on the paving machine 100 to enable operator control over one or more operations, e.g., the paving operation, of the paving machine 100. Further, the operator station 136 may support one or more operator interfaces and/or input devices that may be accessed by the operators for controlling the many functions of the paving machine 100, e.g., during the paving operation. In one example, the operator interface and/or input devices (or the operator station 136 itself) may be stationed elsewhere, e.g., remote to the paving machine 100, such that the many functions of the paving machine 100 may be initiated and/or controlled remotely.

In some embodiments, a coupling (e.g., an operatable coupling) between the chassis 124 and the screed assembly 120 may be attained by way of an assembly of tow arms 140 and actuators 144 (only one tow arm, i.e., tow arm 140', is viewable in FIG. 1). In such a case, the chassis 124 may facilitate transmission of tractive forces to the screed assembly 120, e.g., by way of the tow arms 140. In that manner, the screed assembly 120 may be towed along with the movement of the chassis 124 along the direction, T. Also, the actuators 144 may be connected between chassis 124 and the tow arms 140, and said actuators 144 may be controlled (e.g., for example via controls provided in an operator station 136 of the paving machine 100) to raise, lower, shift, and/or tilt the tow arms 140 and thus the screed assembly 120, relative to the chassis 124. It is also contemplated that the screed assembly 120 may be free to float but could be suitably raised or lowered, e.g., by the actuators 144, for attaining any specific profile or geometry (e.g., a height) of the mat 128.

Figure 4:
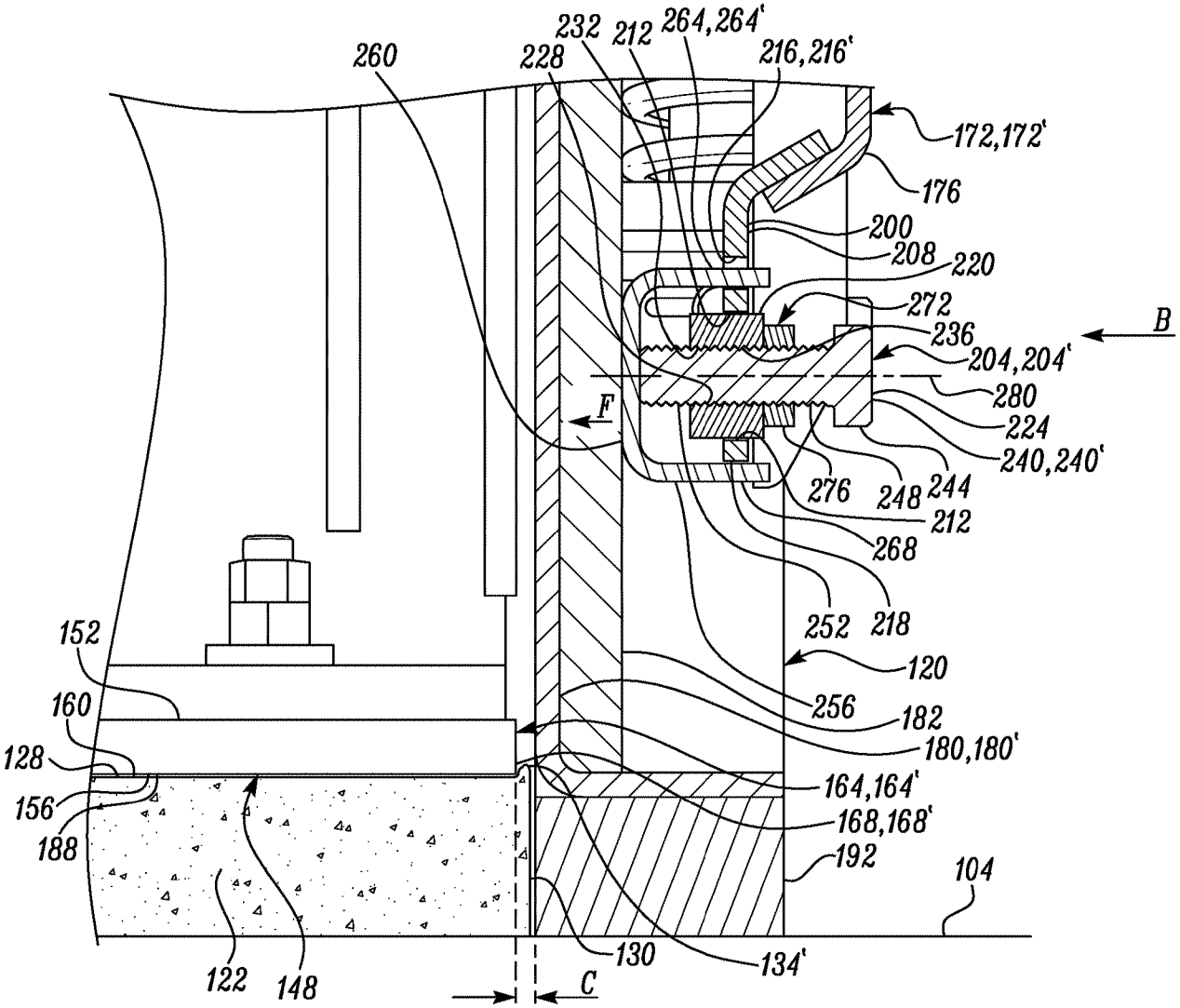
FIGS. 4 and 5 are various rear elevational cross-sectional views of a portion of the screed assembly showing varying clearances between the floating wall and the screed plate that are adjustable by use of the system, in accordance with one or more aspects of the present disclosure.

Referring to FIGS. 2 and 4, the screed assembly 120 may include a screed frame or a screed portion 148. The screed portion 148 may include a screed plate 152 to abut with the material 122 and pave the material 122 to form the mat 128 on the work surface 104 during the paving operation. To this end, the screed plate 152 may define a planar under face portion 156 that may come into contact (e.g., a direct contact) with the material 122 as the material 122 is deposited on the work surface 104 and is received under the screed plate 152 during the paving operation. Said planar under face portion 156 of the screed plate 152 may facilitate the formation of a generally flattened top face or a raised face 160 of the mat 128, as the paving machine 100 moves along the direction, T, during the paving operation. It may be noted that the mat 128 may also define a side face 130 and an edge 134 where the raised face 160 of the mat 128 and the side face 130 of the mat 128 may meet each other.

Also, the screed plate 152 may define laterally opposed sides 164 and laterally opposed edges 168 respectively defined at those laterally opposed sides 164. The laterally opposed sides 164 and the laterally opposed edges 168 may be disposed along a width of the paving machine 100. As an example, the screed plate 152 includes a right side 164' and a right edge 168' defined at the right side 164. Similarly, the screed plate 152 may include a left side and a left edge defined at the left side. The left side and its associated features, such as the left edge, are not visible in the orientations or portions of the paving machine 100 illustrated in FIGS. 1 through 5 but the same can be contemplated or understood by those skilled in the art based on the present disclosure.

In some embodiments, the screed assembly 120 may include multiple screed portions, such as the screed portion 148. In such a case, each screed portion may include a corresponding screed plate (similar to the screed plate 152). As an example, a left screed portion and a right screed portion may be respectively arranged at laterally opposed sides of the screed portion 148 such that the screed portion 148 may be located in between the left screed portion and the right screed portion. In such a case, each of the left screed portion and the right screed portion may be extendable and retractable with respect to the screed portion 148 to adjust a width of the screed assembly 120, and thus of the resulting layer of the mat (such as mat 128) formed on the work surface 104 by the screed assembly 120. Also, in the case of the multiple screed portions, the right edge 168' may be defined on the screed plate associated with the right screed portion and the left edge (not shown) may be defined on the screed plate associated with the left screed portion such that the right edge 168' and the left edge (not shown) may be defined at laterally opposed sides 164 of an assembly of the multiple screed portions.

The screed assembly 120 may further include one or more end gates 172 (only one end gate, e.g., the end gate 172", is visible in the orientations of the paving machine 100 in FIGS. 1 through 5). As an example, the end gates 172 may be respectively provided at or adjacent to the laterally opposed sides 164 of the screed plate 152—thus, in total, the screed assembly 120 may include two end gates 172, with one end gate located at the left side of the screed plate 152 and the other end gate (i.e., end gate 172') located at the right side 164' of the screed plate 152. For the purposes of the present disclosure, only one end gate (e.g., the end gate 172') will be discussed, and those discussions can be applied suitably to the other end gate of the screed assembly 120, as well.

The end gate 172' includes a support structure 176 and a wall 180. The support structure 176 may be coupled (e.g., fixedly coupled) and/or may be immovable with respect to the screed plate 152 of the screed assembly 120. Although not limited, the support structure 176 may be provided at the right side 164' of the screed plate 152, as shown. In some embodiments, the support structure 176 may be part of the screed portion 148 and/or a frame of the screed assembly 120 and/or a staircase unit (not shown) which may be used by an operator to reach up to a walkway platform 184 (see FIG. 1) of the screed assembly 120. In some embodiments, the support structure 176 may be provided independently of one or more of the screed portion 148, the frame of the screed assembly 120, and/or the staircase unit, and may include various other features and/or configurations contemplatable by someone in the art based on the present disclosure, but which are not described for brevity.

Figure 5:
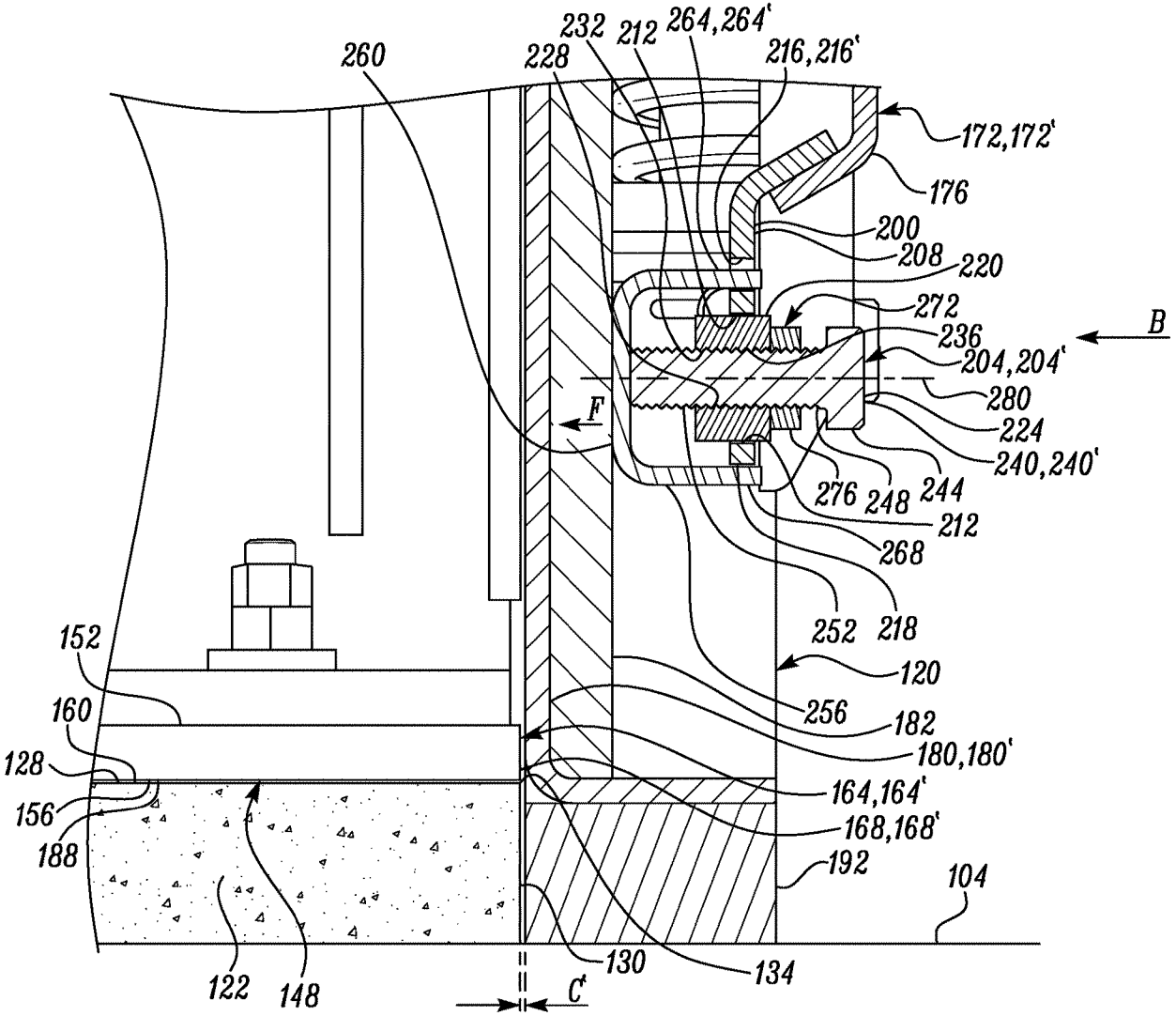

Referring to FIGS. 1, 2, and 4, the wall 180 may be located below the support structure 176 along an elevation, E, (see FIG. 1) of the screed assembly 120 and may abut against the work surface 104 during the paving operation. Also, the wall 180 may be arranged adjacent to the right side 164' or the right edge 168' of the screed plate 152. A clearance, C, may be defined between the wall 180 and the screed plate 152, as shown in FIGS. 4 and 5. The clearance, C, may be exaggerated in FIG. 4 for easy understanding. Also, at least a portion of the wall 180 may extend below a level of the screed plate 152 or may extend away (or downwards) from a plane 188 defined by the planar under face portion 156 of the screed plate 152 during the paving operation (see FIGS. 2, 4, and 5). In that manner, the end gate 172' or the wall 180 may restrict or disallow the spread of the material 122 forced under the screed plate 152 from flowing away or outwards in the lateral direction of the paving machine 100 (e.g., a right lateral direction, LD, in the case of the end gate 172') (FIG. 2).

In some embodiments, the wall 180 may be a floating wall 180'—the term 'floating' as may be used for the wall 180 can be understood to mean that the wall 180 can be disposed in a floating configuration with respect to the support structure 176 and thus may be slidably disposed (e.g., freely slidably disposed) with respect to the support structure 176. By way of the floating configuration and by being slidable relative to the support structure 176, the wall 180 may freely move in a generally vertical direction (see arrow, M) (FIG. 2) with respect to the support structure 176 to be guided along (e.g., to follow the contours and/or undulations of) the work surface 104 as the paving machine 100 moves over the work surface 104 and/or as the paving operation is in progress along direction, T. In some embodiments, the wall 180 may include a shoe 192 to contact the work surface 104.

Effectively, the end gates 172 of the screed assembly 120 may be applied to restrict a spread or dispersal of the material 122 in a lateral direction (e.g., see arrow, LD) (FIG. 2) of the paving machine 100, during the paving operation. In so doing, during the paving operation, a substantial bulk of the material 122 can be gathered by an assembly of the screed plate 152 and the end gates 172 and then as the screed assembly 120 may be made to move or pull over the material 122 gathered and deposited on the work surface 104, the mat 128 of the roadway 108 may be achieved over the work surface 104 in a pre-compacted state.

It may be noted that the terms 'forward/front' and 'rearward/rear', as used in the present disclosure, are in relation to an exemplary direction of travel of the paving machine 100 during the paving operation, as represented by the arrow, T, in FIG. 1. Similar understanding and connotations may be applied for the terms 'left' and 'right', as one may view the paving machine 100 in and along a direction from the screed assembly 120 towards the hopper 116, or, in other words, a direction which is defined along the direction, T.

Figure 3:
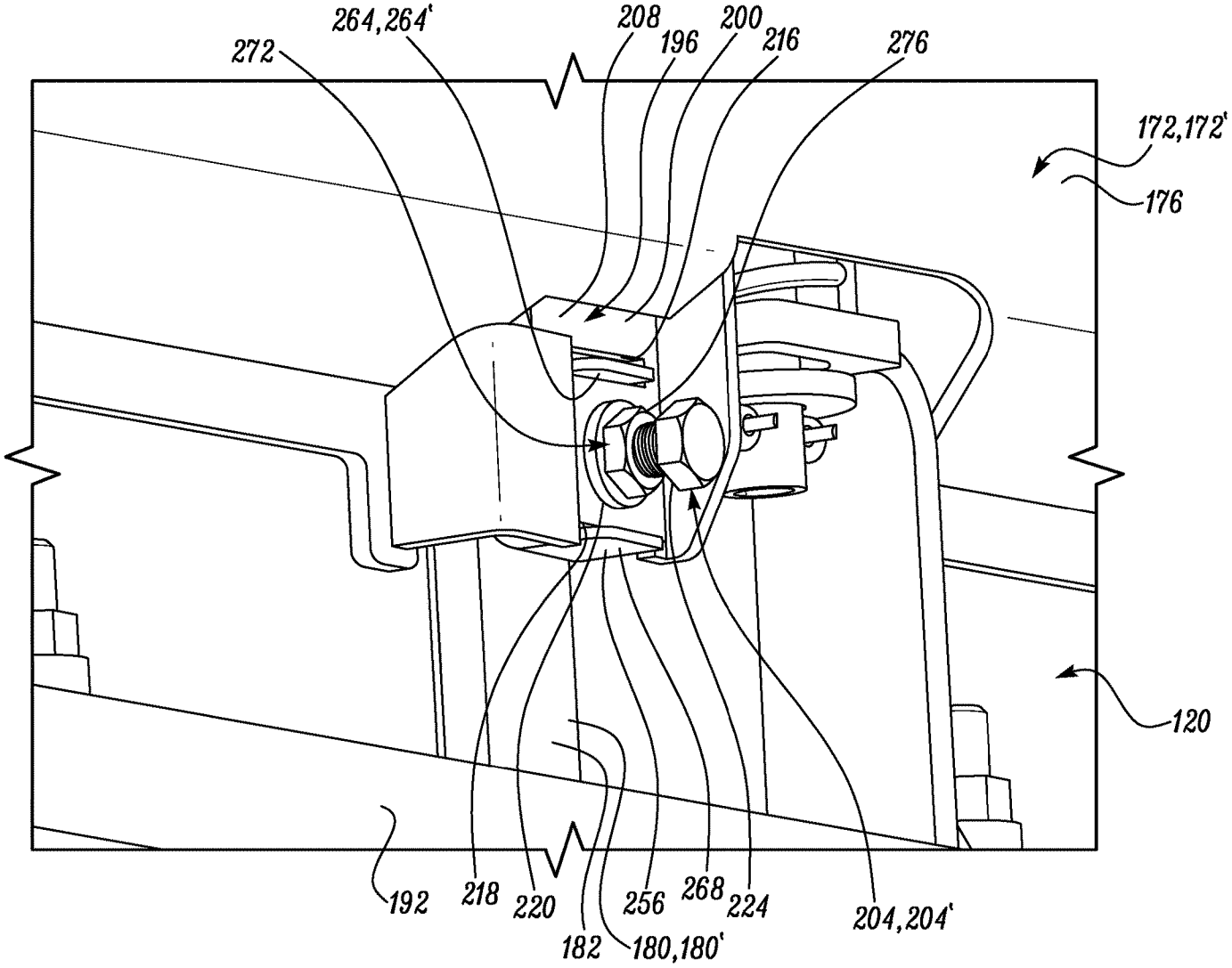
FIG. 3 is a close-up perspective view of a portion of the screed assembly illustrating a system for adjusting a position of a floating wall of the screed assembly with respect to the screed plate of the screed assembly, in accordance with one or more aspects of the present disclosure.

Referring to FIGS. 3 and 4, and also in conjunction with FIGS. 1 and 2, the screed assembly 120 may include a system 196 for adjusting a position of the wall 180 (e.g., the floating wall 180') of the end gate 172' with respect to the screed plate 152. As an example, the position of the wall 180 may be adjusted with respect to the screed plate 152 to adjust the clearance, C, between the wall 180 and the screed plate 152. To this end, the screed assembly 120 may include an engagement portion 200 and one or more compression mechanisms 204, details related to each of which shall now be described.

The engagement portion 200 may include a strip plate 208, and may be coupled (e.g., fixedly coupled) to the support structure 176. A coupling between the engagement portion 200 and the support structure 176 may be attained by any method, now known or in the future developed, and may exemplarily include one or more of welding, bolting, and/or riveting. In some embodiments, the engagement portion 200 may be integrally formed with the support structure 176. Thus, in some cases, the engagement portion 200 may be a part of the support structure 176. Although not limited, a material of the engagement portion 200 may also be same as that of the support structure 176. In one example, an integration of the engagement portion 200 and the support structure 176 may be attained by casting a suitable material, e.g., a suitable metallic material applicable for each of the support structure 176 and the engagement portion 200, into a common mold (not shown). The engagement portion 200 may define an aperture 212, one or more channels 216 (e.g., see channel 216'), and an end surface 218, as shown.

The compression mechanisms 204 may be used to locate the wall 180 with respect to the engagement portion 200 or the support structure 176 such that the wall 180 can be adjusted with respect to (e.g., biased towards) the screed plate 152. As an example, the system 196 may include two compression mechanisms—a first compression mechanism 204 and a second compression mechanism 204". A higher or lesser number of compression mechanisms 204 may be contemplated. For the purposes of the present disclosure, only the first compression mechanism 204' is described. Aspects described for the first compression mechanism 204 may be suitably applicable to the second compression mechanism 204" as well. Also, the first compression mechanism 204' may be simply and/or interchangeably referred to as compression mechanism 204. The compression mechanism 204 may include a nut 220 and at least one compression member, e.g., a compression member 224.

The nut 220 may include a threaded boss piece and may be inserted and received into the aperture 212 defined by the engagement portion 200. In one example, the nut 220 may be fixedly coupled (e.g., by welding) into the aperture 212 and/or with the engagement portion 200 such that the nut 220 can be immovably retained with respect to the engagement portion 200 and/or to the support structure 176. Further, the nut 220 may define an internal surface 228 defining a through hole 232 of the nut 220 and threads 236 may be formed on the internal surface 228.

The compression member 224 may be disposed in an engaged state with respect to at least one of the engagement portion 200 (or the support structure 176) and the wall 180. In the disclosed embodiment, the compression member 224 is exemplarily disposed in engagement with respect to the engagement portion 200, as shown in FIGS. 4 and 5. More particularly, the compression member 224 may be disposed in engagement (e.g., in threadable engagement) with the nut 220 so as to be in engagement with respect to the engagement portion 200 and thus also to the support structure 176.

In this regard, the compression member 224 may include or correspond to at least one threadable fastener (see threadable fastener 240). For example, the compression member 224 may correspond to or include a bolt 240' that may define a head portion 244 and a shank portion 248. The shank portion 248 may define a threaded region 252 which may be engaged with the threads 236 formed on the internal surface 228 of the nut 220 such that an actuation of the compression member 224 (e.g., an application of torque on the compression member 224) can cause the compression member 224 to linearly move back and forth through the through hole 232 and along an axis 280 defined by the through hole 232. In that manner, the nut 220 threadably receives the compression member 224 therethrough to threadably engage the compression member 224 with respect to the engagement portion 200 or with respect to the support structure 176.

As an example, an application of torque on the compression member 224 may cause the compression member 224 to move (see direction, B) with respect to the nut 220 and come into contact (e.g., direct or indirect contact) with the wall 180. In the case of the bolt 240', for example, an application of torque on the head portion 244 may cause the shank portion 248 to come into direct or indirect contact with the wall 180 (such as with a protruded portion 182 of the wall 180, as shown). Once the compression member 224 may contact the wall 180, a further application of torque may cause the wall 180 to be pushed away from the engagement portion 200 and/or the support structure 176 and move towards the screed plate 152 (e.g., the right side 164' or the right edge 168' of the screed plate 152) thus adjusting or reducing the clearance, C, to a clearance, C', (compare FIGS. 4 and 5) defined between the wall 180 and the screed plate 152. A condition in which the compression member 224 adjusts (e.g., sets or reduces) the clearance, C, to the clearance, C', may be referred to as a first condition of the compression member 224—said first condition is illustrated in FIG. 5. In other words, the compression member 224 may be configured to be actuated or moved to the first condition with respect to the engagement portion 200 (or with respect to the support structure 176) so as to push the wall 180 away from the support structure 176 and set and reduce the clearance, C, defined between the wall 180 and the screed plate 152 to the clearance, C'.

In some embodiments, the compression mechanism 204 may include an abutting piece 256. The abutting piece 256 may be disposed (at least partially) between the compression member 224 and the wall 180 (e.g., between the compression member 224 and the protruded portion 182). In that manner, the abutting piece 256 allows the compression member 224 to contact (e.g., indirectly contact) the wall 180 in the first condition (see FIG. 5). More particularly, the abutting piece 256 may be configured to abut the wall 180 in the first condition of the compression member 224 and also distribute a force, F, exerted by the compression member 224 over a portion of the wall 180 when the compression member 224 is actuated and/or moved to the first condition.

According to an example, the abutting piece 256 may include a base 260, a first side wall portion 264, and a second side wall portion 268. Each of the first side wall portion 264 and the second side wall portion 268 may be disposed at an angle to the base 260. In some embodiments, the first side wall portion 264 and the second side wall portion 268 may be disposed parallely to each other. In some embodiments, the base 260 may be disposed orthogonally to each of the first side wall portion 264 and the second side wall portion 268. Further, in an assembly of the abutting piece 256 with the engagement portion 200, the first side wall portion 264 may be received (e.g., freely and/or without restriction) into the channel 216' of the engagement portion 200, while the second side wall portion 268 may be slidably disposed or abutted against the end surface 218 of the engagement portion 200, as shown in FIGS. 3, 4 and 5.

In some embodiments, the system 196 or the screed assembly 120 may further include a mechanism 272 to prevent the compression member 224 from self-adjustments or from freely moving back and forth through the through hole 232 of the nut 220. Such self-adjustments of the compression member 224 may arise from a variety of factors, such as a vibration of the screed assembly 120 during the paving operation, operator error, ingress of contaminants between components, etc. Said mechanism 272 may include one or more auxiliary nuts (e.g., an auxiliary nut 276). The auxiliary nut 276 may be threadably mounted to the threadable fastener 240 (e.g., to the shank portion 248 of the bolt 240'). When an ideal position of the compression member 224 or the first condition of the compression member 224 is achieved, the auxiliary nut 276 may be torqued about the shank portion 248 and tightened against the engagement portion 200 or the nut 220 so as to abut and be retained against the engagement portion 200 or the nut 220. Such abutment helps maintain the compression member 224 in the ideal position or the first condition.

INDUSTRIAL APPLICABILITY

During the paving operation, if an operator observes a variation in a profile or a geometry of the mat 128, e.g., an undesirable interruption or distortion in the edge 134 (see distorted edge 134' which may include a raised strip at the edge 134, FIG. 4) of the mat 128, the operator may grab a tool, such as a spanner or a wrench (not shown) and may use the tool to turn the compression member 224 to apply torque on the compression member 224. Prior to the application of torque, the compression member 224 may be in an initial condition. The application of torque on the compression member 224 may actuate the associated compression mechanism (e.g., the first compression mechanism 204). Also, the torque on the compression member 224 may be applied by engaging the head portion 244 with the tool and then turning the tool to turn the head portion 244 (and thus the compression member 224) along with the tool inside the through hole 232 of the nut 220. Such turning may be attained about the axis 280 defined by the through hole 232.

As a result of such turning, the threaded region 252 of the compression member 224 may engage with the threads 236 of the internal surface 228 of the through hole 232 and may move linearly (e.g., along the axis 280) through the nut 220, e.g., in the direction, B. Such movement may cause the compression member 224 or the shank portion 248 (in case the compression member 224 includes the bolt 240') to move and abut against the abutting piece 256 (see state of compression member 224 in FIG. 4). A further turning of the compression member 224, e.g., by way of further turning the tool in the same direction, may cause the abutting piece 256 to move and contact a portion (e.g., the protruded portion 182) of the wall 180 (also shown in FIG. 4). At this point, the clearance, C, may be defined between the wall 180 and the screed plate 152. The clearance, C, may be exaggerated in FIG. 4 for understanding and/or illustrative purposes.

A continued application of torque on the compression member 224 may then cause the abutting piece 256 to push against the wall 180 and accordingly press the wall 180 in the direction, B. Said push against the wall 180 may result in a movement of the compression member 224 to the first condition and a concomitant or simultaneous repositioning of the wall 180 with respect to the screed plate 152 (or with respect to the right edge 168' of the screed plate 152). The repositioning causes an adjustment of the clearance, C, to the clearance, C' (see FIGS. 4 and 5 in cohesion).

More particularly, the adjustment of the clearance, C, to the clearance, C', in the present example in which the compression member 224 is moved in direction, B, may correspond to a reduction in the clearance, C, to the clearance, C', which results in the wall 180 and the screed plate 152 coming closer to each other. Effectively, it may be noted that the compression member 224 is moved to the first condition with respect to the engagement portion 200 or the support structure 176 so as to push the wall 180 away from the support structure 176 and reduce the clearance, C, between the wall 180 and the screed plate 152 to a reduced clearance, C'.

Therefore, with the reduced clearance, C', as the screed assembly 120 moves over the material 122, the edge 134 of the mat 128 may attain the edge 134 which is substantially uninterrupted and sharp (see FIG. 5). In that manner, the system 196 helps in the formation of a substantially uninterrupted sharp edge (i.e., edge 134) of the mat 128 and it will be appreciated that the reduction in the clearance, C, to the clearance, C', may mitigate or altogether eliminate the possibility of formation of the distorted edge 134 of the mat 128.

The term substantially uninterrupted sharp edge, used above for the edge 134, may mean that for a predetermined length of the mat 128, e.g., for 2.5 meters, a minimum number of perceivable features formed at the edge 134 that may make the edge 134 appear distorted or interrupted (such as the distorted edge 134' or mat crumbling) is under a predetermined number. As an example, the predetermined number may be 3 (three). Of course, such numbers may change based on factors, such as operator preference, type of the paving machine 100, and/or type of the material 122. In some embodiments, a substantially uninterrupted sharp edge of the mat 128 may be formed when the clearance, C', between the wall 180 and the screed plate 152 is not more than 0.25 mm (millimeters).

Also, it may be noted that a coefficient of friction defined between the abutting piece 256 and the wall 180 (or the protruded portion 182 of the wall 180) may be sufficiently low to allow the wall 180 to freely float and/or slide relative to the support structure 176 in the first condition of the compression member 224. In other words, even with the maintenance of the clearance, C', between the wall 180 and the screed plate 152, the wall 180 may freely float and/or remain slidable relative to the support structure 176 so that the wall 180 can be guided along (e.g., to follow the contours of) the work surface 104. Moreover, it may be noted that during a transition of the compression member 224 from the initial condition to the first condition, the first side wall portion 264 of the abutting piece 256 may serve as a track 264 (see FIGS. 3, 4, and 5) which may correspondingly cooperate with the channel 216' of the engagement portion 200 to facilitate a guidance of the abutting piece 256 along the track 264'. It may be noted that, in both the initial condition and in the first condition, the track 264 or the first side wall portion 264 may remain guided and engaged with the channel 216' to retain the abutting piece 256 with the engagement portion 200. Furthermore, during the transition to the first condition, the second side wall portion 268 may slide against the end surface 218 to support the guidance and movement of the abutting piece 256 along the track 264' or the first side wall portion 264.

Similar discussions and procedures may be contemplated for a working of the second compression mechanism 204", as well. Further, the operator may also adjust the end gate (not shown) located at the left side of the screed plate 152 with respect to the left edge of the screed plate 152 in a similar manner as has been discussed above if a distortion is noticed or observed at an edge of the mat 128 at or close to the left side of the screed plate 152. By way of the compression mechanisms 204 of the system 196 and/or of the screed assembly 120, clearances between the screed plate 152 and one or more of the end gates 172 may be adjusted and reduced as desired. In that manner, a surface quality and aesthetics of the mat 128 (e.g., of the edge 134 of the mat 128) may be significantly improved, which in turn enhances a visual appeal of the roadway 108 and increases customer and end user satisfaction.

The term "coupled" as employed herein is used broadly and encompasses both direct and indirect connections between two components-direct meaning at least portions of the two components are in contact with one another, possibly with the use of fasteners or fastening material, and indirect meaning at least portions of the two components are in contact with at least portions of at least one intermediate structure therebetween, possibly with the use of fasteners or fastening material.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A screed assembly for a paving machine, the screed assembly comprising:

a screed plate to pave a material to form a mat on a work surface;

an end gate to restrict a spread of the material in a lateral direction of the paving machine during a paving operation, the end gate including:

a support structure including an engagement portion; and a floating wall slidably disposed relative to the support structure and configured to be guided along the work surface during the paving operation;

one or more compression mechanisms, at least one compression mechanism of the one or more compression mechanisms including:

at least one compression member disposed in an engaged state with respect to at least one of the engagement portion and the floating wall, the at least one compression member including at least one threadable fastener; and a nut coupled to the engagement portion to threadably receive the at least one compression member therethrough to threadably engage the at least one compression member with respect to the engagement portion, wherein an actuation of the at least one compression member moves the floating wall with respect to the screed plate to adjust a clearance between the floating wall and the screed plate, and wherein the at least one compression member is engaged with respect to the engagement portion and is configured to be moved to a first condition with respect to the engagement portion to push the floating wall away from the support structure and reduce the clearance between the floating wall and the screed plate; and at least one auxiliary nut threadably mounted to the at least one threadable fastener, the at least one auxiliary nut being abuttable against the engagement portion or the nut to maintain the at least one compression member in the first condition.

2. The screed assembly of claim 1, wherein an adjustment of the clearance corresponds to a reduction in the clearance, enabling the floating wall and the screed plate to form a substantially uninterrupted sharp edge of the mat where a raised face of the mat and a side face of the mat meet each other.

3. The screed assembly of claim 1, wherein each compression mechanism includes an abutting piece disposed between the at least one compression member and the floating wall, the abutting piece configured to abut and distribute a force exerted by the at least one compression member over a portion of the floating wall when the at least one compression member is moved to the first condition.

4. The screed assembly of claim 3, wherein a coefficient of friction defined between the abutting piece and the floating wall is allows the floating wall to slide relative to the support structure in the first condition of the at least one compression member.

5. The screed assembly of claim 4, wherein one of the abutting piece and the engagement portion defines one or more tracks and the other of the abutting piece and the engagement portion defines one or more channels, the one or more tracks correspondingly cooperating with the one or more channels to facilitate a guidance of the abutting piece along the one or more tracks during a transition of the at least one compression member to the first condition.

6. The screed assembly of claim 5, wherein, in the first condition, the one or more tracks remain correspondingly guided and engaged with the one or more channels to retain the abutting piece with the engagement portion.

7. A paving machine, comprising:

a tractor;

a hopper coupled to the tractor and configured to receive a material for deposition over a work surface;

a screed assembly coupled to the tractor, the screed assembly including:

a screed plate to pave the material to form a mat on the work surface;

an end gate to restrict a spread of the material in a lateral direction of the paving machine during a paving operation, the end gate including:

a support structure including an engagement portion; and a floating wall slidably disposed relative to the support structure and configured to be guided along the work surface during the paving operation;

one or more compression mechanisms, at least one compression mechanism of the one or more compression mechanisms including:

at least one compression member disposed in an engaged state with respect to at least one of the engagement portion and the floating wall, the at least one compression member including at least one threadable fastener; and a nut coupled to the engagement portion to threadably receive the at least one compression member therethrough to threadably engage the at least one compression member with respect to the engagement portion, wherein an actuation of the at least one compression member moves the floating wall with respect to the screed plate to adjust a clearance between the floating wall and the screed plate, and wherein the at least one compression member is engaged with respect to the engagement portion and is configured to be moved to a first condition with respect to the engagement portion to push the floating wall away from the support structure and reduce the clearance between the floating wall and the screed plate; and at least one auxiliary nut threadably mounted to the at least one threadable fastener, the at least one auxiliary nut being abuttable against the engagement portion or the nut to maintain the at least one compression member in the first condition.

8. The paving machine of claim 7, wherein an adjustment of the clearance corresponds to a reduction in the clearance, enabling the floating wall and the screed plate to form a substantially uninterrupted sharp edge of the mat where a raised face of the mat and a side face of the mat meet each other.

9. The screed assembly of claim 7, wherein each compression mechanism includes an abutting piece disposed between the at least one compression member and the floating wall, the abutting piece configured to abut and distribute a force exerted by the at least one compression member over a portion of the floating wall when the at least one compression member is moved to the first condition.

10. The paving machine of claim 9, wherein a coefficient of friction defined between the abutting piece and the floating wall allows the floating wall to slide relative to the support structure in the first condition of the at least one compression member.

11. The paving machine of claim 10, wherein one of the abutting piece and the engagement portion defines one or more tracks and the other of the abutting piece and the engagement portion defines one or more channels, the one or more tracks correspondingly cooperating with the one or more channels to facilitate a guidance of the abutting piece along the one or more tracks during a transition of the at least one compression member to the first condition.

12. The paving machine of claim 11, wherein, in the first condition, the one or more tracks remain correspondingly guided and engaged with the one or more channels to retain the abutting piece with the engagement portion.

13. A system for adjusting a position of a floating wall of an end gate with respect to a screed plate of a screed assembly, the system comprising:

an engagement portion configured to be coupled to a support structure of the end gate;

one or more compression mechanisms, at least one compression mechanism of the one or more compression mechanisms including:

at least one compression member disposed in an engaged state with respect to at least one of the engagement portion and the floating wall, the at least one compression member actuatable or movable to a first condition to set a clearance between the floating wall and the screed plate; and an abutting piece disposed between the at least one compression member and the floating wall, the abutting piece configured to abut and distribute a force exerted by the at least one compression member over a portion of the floating wall when the at least one compression member is moved to the first condition, wherein one of the abutting piece and the engagement portion defines one or more tracks and the other of the abutting piece and the engagement portion defines one or more channels, the one or more tracks correspondingly cooperating with the one or more channels to facilitate a guidance of the abutting piece along the one or more tracks during a transition of the at least one compression member to the first condition, and wherein, in the first condition, the one or more tracks remain correspondingly guided and engaged with the one or more channels to retain the abutting piece with the engagement portion.

* * * * *